US006880780B1

(12) United States Patent
Perry et al.

(10) Patent No.: US 6,880,780 B1
(45) Date of Patent: Apr. 19, 2005

(54) COVER EJECTION AND FIN DEPLOYMENT SYSTEM FOR A GUN-LAUNCHED PROJECTILE

(75) Inventors: Craig Perry, Santa Rosa, CA (US); Richard W. Schroeder, Healdsburg, CA (US); Allan A. Voigt, Geyserville, CA (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 0 days.

(21) Appl. No.: 10/390,423

(22) Filed: Mar. 17, 2003

(51) Int. Cl.[7] ..... F42B 15/01

(52) U.S. Cl. ..... 244/3.27; 244/49

(58) Field of Search ..... 244/3.27, 3.24, 244/3.3, 3.1, 49

(56) References Cited

U.S. PATENT DOCUMENTS

| | | | | |
|---|---|---|---|---|
| 4,296,895 | A * | 10/1981 | Pazmany | 244/3.29 |
| 4,523,728 | A * | 6/1985 | Frazer | 244/3.29 |
| 6,073,880 | A * | 6/2000 | Voigt et al. | 244/3.28 |
| 6,224,013 | B1 * | 5/2001 | Chisolm | 244/3.27 |
| 6,446,906 | B1 * | 9/2002 | Voigt et al. | 244/3.27 |
| 6,581,871 | B1 * | 6/2003 | Pijaca et al. | 244/3.27 |

* cited by examiner

*Primary Examiner*—Peter M. Poon
*Assistant Examiner*—Timothy D. Collins
(74) *Attorney, Agent, or Firm*—Hunton & Williams LLP

(57) ABSTRACT

A fin cover release and deployment system designed for high G forces of gun-launched missiles. In one embodiment, a pyrotechnic actuator drives actuator arms to first release and eject the fin slot covers, followed by deployment of the fins radially outward to the steering position. Following complete ejection of the covers, the fins are driven outwardly by cam surfaces along the latch arms, followed by a spring and wedge mechanism installed interiorly of the fin steering shaft to lock the fins in the fully deployed state. In another embodiment, a motor and rotating threaded shaft replace the pyrotechnic actuator.

20 Claims, 11 Drawing Sheets

COVER EJECTION AND FIN DEPLOYMENT SYSTEM FOR A GUN-LAUNCHED PROJECTILE

BACKGROUND OF THE INVENTION

1. Field of the Invention

The present invention generally relates to a system for latching the fin covers of a missile having retractable folding fins in the stowed position and for releasing and jettisoning the covers to permit deployment of the fins upon command following launch of the missile.

2. Description of the Related Art

Presently existing mechanisms for fin deployment on gun-launched projectiles are both complex and expensive. The requirement to withstand the acceleration forces, which typically range from 10,000 to 30,000 G's, places very stringent demands on the mechanisms. Therefore, the designs are required to be extremely robust in order to withstand the loads induced by these accelerations. It is a purpose of this invention to show a simple but unique configuration that is both low cost to produce and extremely robust. It is particularly capable of withstanding extreme accelerations.

Presently, existing actuators for fin deployment on gun-launched projectiles typically employ multiple pyrotechnics to eject the covers and additional spring-loaded mechanisms to deploy the fins. Typically, each separate cover being jettisoned requires its own pyro device. Such systems also require wires to be connected to each individual pyrotechnic device, thus adding to the cost and complexity of the systems.

A key objective of the present invention is to be able to withstand the severe accelerations during gun launch and subsequently to function correctly during flight. It is desired to retain the covers over the canard slots throughout the storage life of the round and during the gun launch as well as in the initial portion of the flight. It is then desired to release the covers upon command from the flight control system and eject them in such a way that the covers do not impact any portion of the vehicle, such as the tail fins, as they are jettisoned. Further, at the time the covers are jettisoned the fins are to unfold from within the vehicle and extend into their flight controlling positions in the airstream.

One particular application Ser. No. 09/825,808, entitled FIN AND COVER RELEASE SYSTEM and assigned to the assignee of the present application, describes a system which uses a single electrically initiated pyrotechnic actuator (pyro device) which, upon activation, drives a piston to move a mechanism which first unlatches the covers and then pushes them off, all at the same time. The content of that particular application is incorporated herein by reference, as though set out in haec verba.

There still remains, however, a need to control the deployment of the fins over a wider range of aerodynamic conditions. Such control is needed to avoid excessive fin velocity during deployment which, when the fin is abruptly stopped at its deployed position, might break off the fin support arm or do other structural damage. That problem is met by separate means in each of the two embodiments disclosed herein.

SUMMARY OF THE INVENTION

In brief, particular arrangements in accordance with the invention incorporate apparatus for the control, storage and deployment of the steering fins of a missile. In storage, these fins are protected by covers which are firmly latched in the stowed position. In such position, the covers serve to prevent the fins from deployment. They provide aerodynamic fairing and also sealing of the actuator assembly during long-term storage. The system has the capability of withstanding the shocks and high G forces of the launch procedure, including those encountered during launch from a gun which may reach a level of 30,000 G's. Following the launch phase, once the guided portion of the flight is commenced, arrangements of the invention provide for the immediate and simultaneous release and jettisoning of the covers, followed by deployment of the fins into proper control positions. Because of the large aerodynamic forces due to drag, the fins must be pushed into the air stream until they reach the fully deployed position, at which point they must be locked into that condition.

In one particular embodiment of the invention, the activation of the system begins with the firing of a single pyrotechnic device. The pyrotechnic device and its associated piston actuator are so constructed and oriented that the actuating force is directed axially along the center of the missile. As the pyrotechnic actuator piston extends, it drives a central shaft on which a rack gear is mounted. This gear is coupled to each of a plurality, one for each fin, of actuator links (or latch arms) via corresponding gear sectors on each link. Each link is mounted on a pivot member and has a projecting cover latch finger on one end and an extended arm portion on the other.

The combination of the pyrotechnic device and its associated piston actuator also includes a damping device which limits the rate at which energy is transferred from the pyro device to the deployment mechanisms. This involves an auxiliary piston/cylinder which hydraulically dampens the pyrotechnic device so that the deployment velocity of the fins does not reach a level where damage is likely to result.

During storage and in the initial launch phase, the latch finger extends into a slot in the associated fin cover to latch it securely in the closed position. After launch of the missile and subsequent firing of the pyrotechnic device, the actuator links rotate about their pivot members, releasing the covers from the latched position and camming them outward into the air stream where the jettisoning of the covers is quickly completed by the external aerodynamic forces. Further rotation of the actuator links brings the extended arm portions to bear against their respective fins, causing the fins to rotate outward through their fin slots until full deployment is attained.

The fins themselves are mounted on respective canard pins at the forward ends of the fins (as retracted). Once the fins reach the fully-deployed position, they must be locked in that condition. A locking mechanism comprises a wedge system located internally of the fin steering shaft. This system includes a wedge that is driven radially outward by an internal biasing spring as the fin is deployed until the wedge engages a locking surface on the trailing edge of the fin. Since the wedge biasing spring has a relatively low force, it is necessary to push the fin radially outward until it is completely, or very nearly completely, into the fully deployed position.

Since the mechanism that pushes the fin into place is mounted on the missile airframe and not on the output shaft, it is necessary that upon full deployment the fin does not rub on the deployment mechanism. This can be accomplished in a number of ways. The simplest approach is to stop the mechanism just short of the fully deployed position, from which point the internal wedge has adequate force to finish locking the fin into the final position. Another approach is to configure the mechanism so that it over-travels at the final motion and therefore clears the trailing edge of the fin. A second alternative is to provide for reverse motion after the fin reaches the final deployed position, then having the mechanism back up to provide adequate clearance for the fin's trailing edge.

A second embodiment in accordance with the invention utilizes an electric motor instead of the pyrotechnic device in the mechanism for releasing and ejecting the fin covers and deploying the fins. In this embodiment, an electric motor with a screw drive is used in place of the pyrotechnic device. As a further feature in this second embodiment, an additional cover eject spring is provided for each cover to assist in driving the covers with sufficient velocity to ensure that their trajectory clears the missile tail fins. Such helper springs are not required in the pyrotechnic actuator system because such actuators provide high enough impulse power that they serve to eject the covers with the needed velocity and momentum. In the electric motor actuator embodiment, the ejection assist spring for each cover is mounted in a way which causes the spring to be compressed during cover installation. When the latch is released by the electric motor driving the actuator links, the spring accelerates the cover away from the missile body.

In this second embodiment of the invention, the problem of limiting the deployment velocity of the fins over a wide range of aerodynamic conditions is resolved by the design of the electric motor and the electrical system for activating the motor. The control system limits the velocity of the motor shaft rotation which, in turn, limits the velocity of the fins during deployment.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

Figure 1:
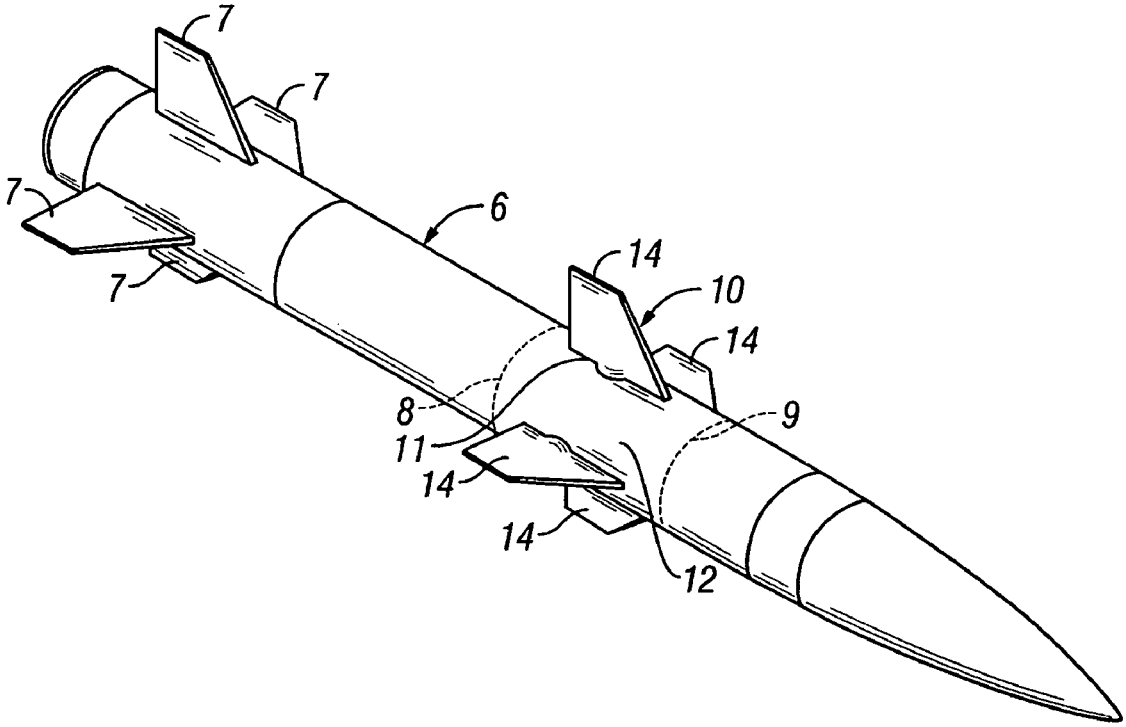
FIG. 1 is a schematic view of a missile incorporating an arrangement of the present invention.

FIG. 1 shows a missile 6 of the type to which the cover ejection and fin deployment system of the invention is adapted and is included merely for clarification. The missile 6 is shown having tail fins 7 and forward canard fins 14. As deployed, the fins 14 project outwardly through slots 11 in the missile skin 12. The fin deployment actuator 10 of the present invention, as shown in the schematic sectional views of the following figures, is situated approximately in the portion of the missile between the broken lines 8, 9.

First Preferred Embodiment

Figure 2:
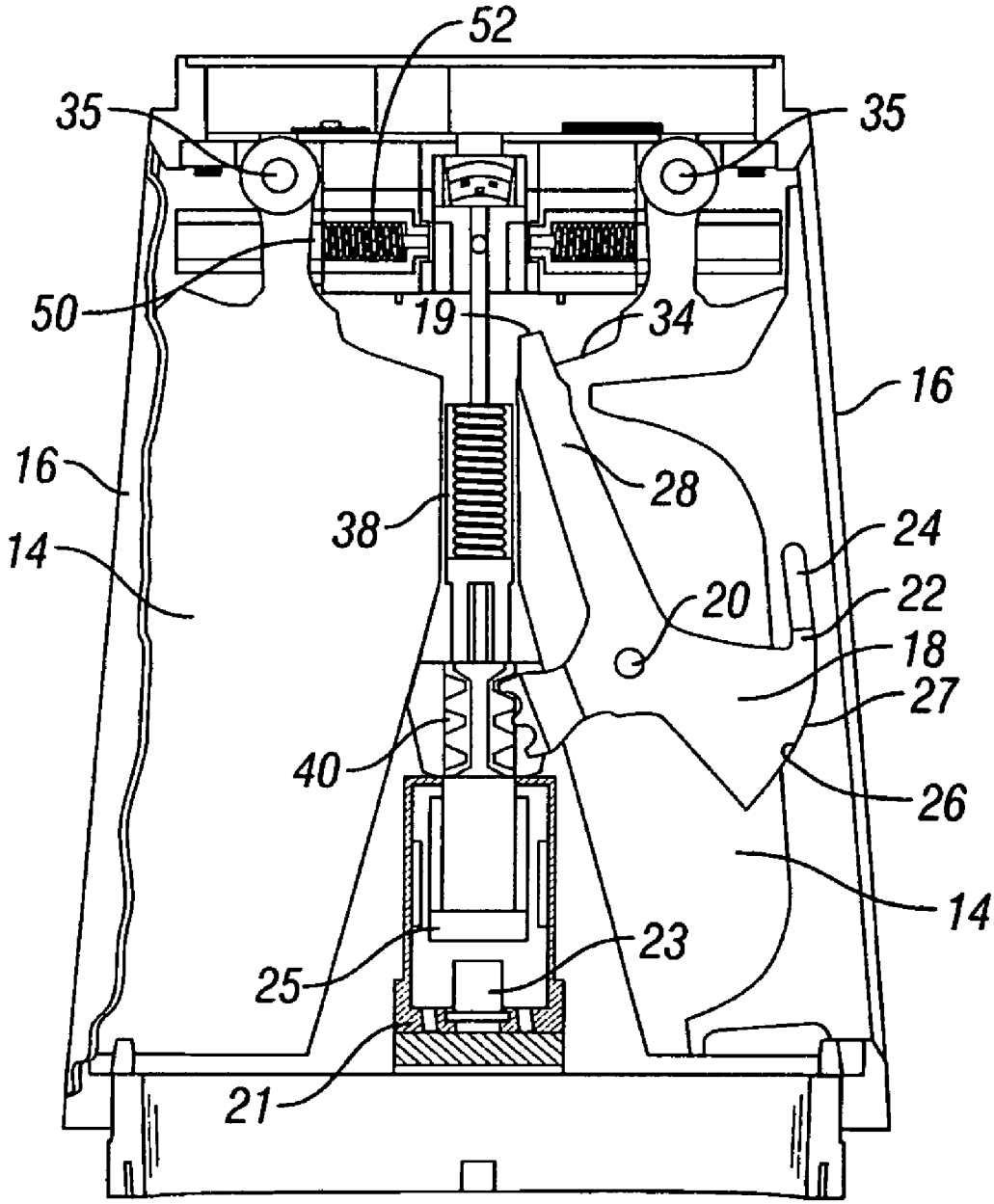
FIG. 2 is a schematic sectional view, partially broken away, of one particular arrangement of the invention showing the actuator system apparatus with the fins in the fully stowed position.

As shown in the drawings, particularly referring to FIG. 2, the actuator 10 is shown as it would be installed in a section of a missile 12 with a pair of fins, or canards, 14 in the stowed position. The actuator apparatus 10 is usually comprised of four fins, but alternatively two or three fins could be used. FIG. 2 shows the condition of the actuator 10 during gun launch and the initial portion of the flight. A pair of covers 16, one for each fin, are installed over the slots through which the fins deploy. However, only one cover is shown in FIG. 2 with its associated link, or latch arm, 18. The cover and latch arm on the left-hand side of FIG. 2 have been omitted to show details of the corresponding fin 14.

These covers 16 provide aerodynamic fairing and also seal the actuator assembly during long-term storage. They are held tightly closed against a gasket (not visible) during long-term storage and maintain a tight enough seal during the launch phase and flight phase to maintain aerodynamic flow. This serves to reduce aerodynamic drag on the projectile during the initial portion of the flight. Once the guided portion of the flight is commenced, the covers 16 are ejected and the fins are deployed.

The covers 16 have a slot 24 extending longitudinally along an interior surface to receive an extending latch finger 22 on the latch arm 18. This arrangement holds the covers 16 tightly in place until release and initial deployment of the fins 14 is begun with the actuation of the pyrotechnic device 23.

Each latch arm 18 is mounted on a pivot pin 20 permitting rotation between latched and open positions. Each latch arm has a projecting finger element 22 that extends into the latching slot 24 in the fin cover 16. An extending forward portion 28 of the latch arm 18 is positioned to drive the cover 16 outward, into a slipstream for ejection, through contact with an inwardly extending portion 33 of the cover 16. After that, the end 19 of the link 28 engages the edge 34 of the fin 14 to deploy the fin. Each fin 14 is mounted to rotate about a fin pivot pin 35. Release of the cover 16 and beginning ejection thereof occurs as the latch arm 18 rotates clockwise to a position, shown in FIG. 3, where the finger 22 releases from the slot 24 and mating cam surfaces 26, 27 of the latch arm and the cover serve to move the cover outwardly.

Rotation of the latch arm 18 from the stowed position shown in FIG. 2 results from expanding gas pressure in the cylinder 21 caused by the ignition of the pyro device 23, drives the piston 25 and attached central shaft forward. A rack and gear mechanism 40 couples the forward motion of the shaft 38 to the latch arm 18, driving it to rotate about the pivot pin 20.

Figure 3:
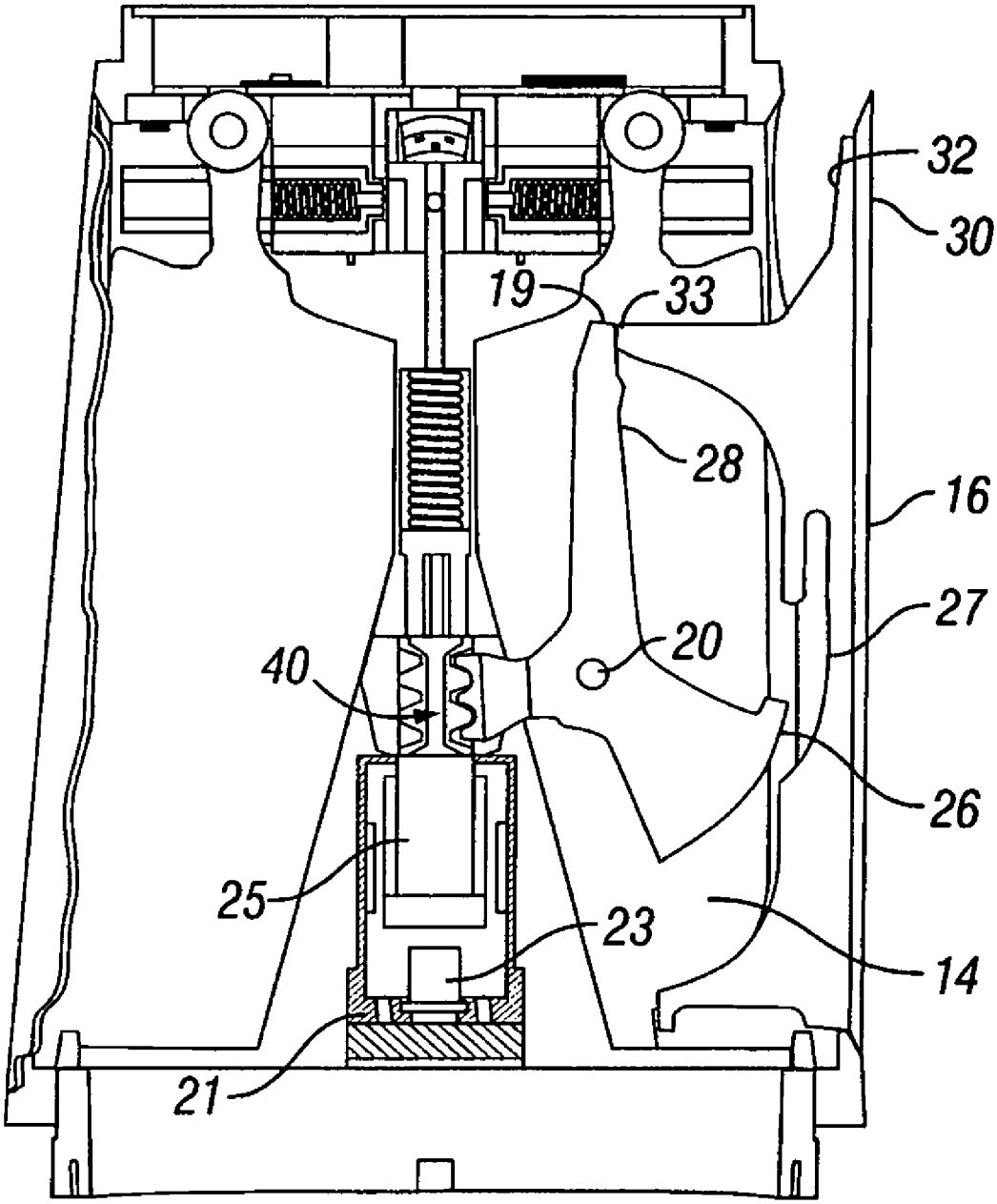
FIG. 3 is a schematic partial sectional view of the apparatus of FIG. 2 showing the positions of the system components as the fin covers are unlatched and beginning to be ejected.
Figure 3A:
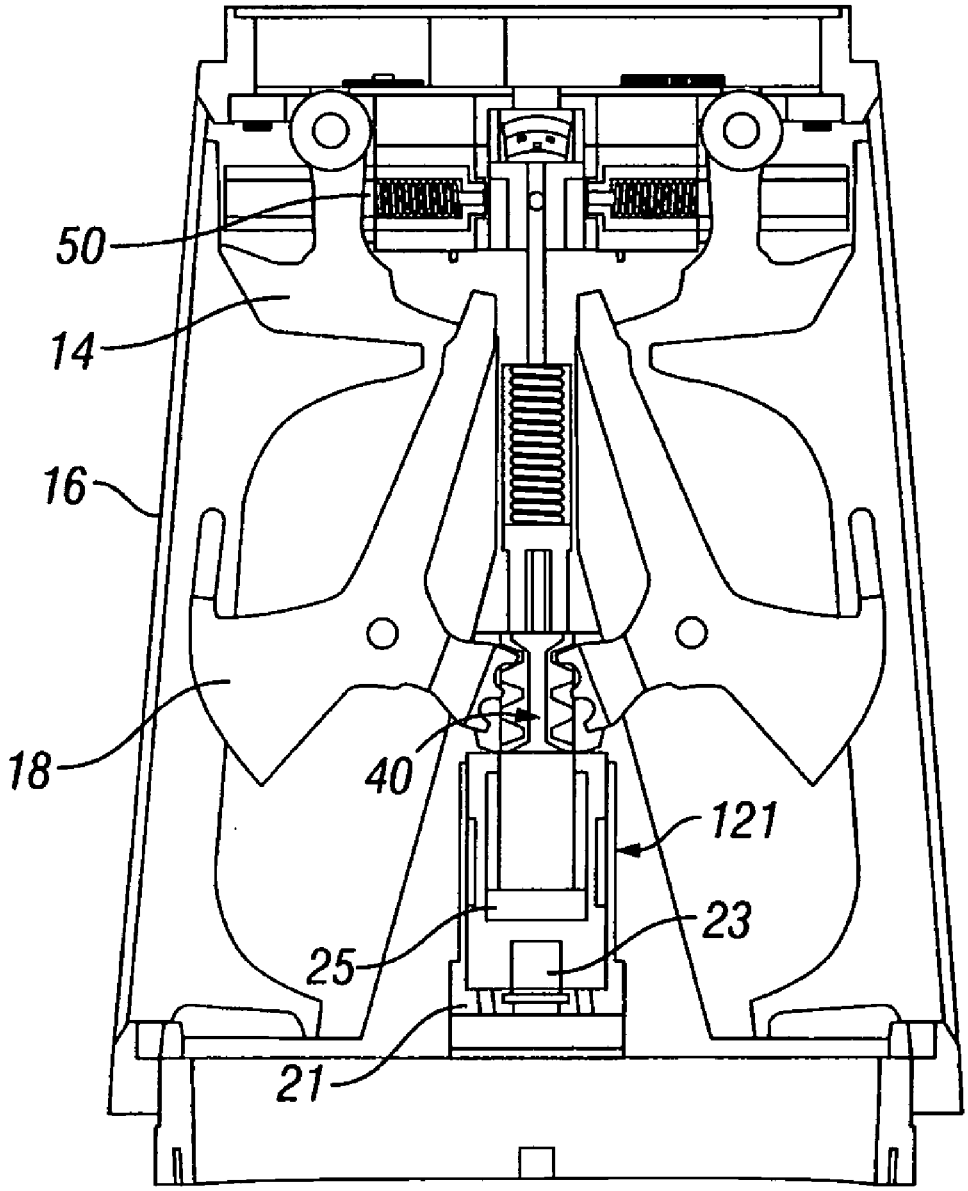
FIG. 3A is a schematic sectional view similar to the views of FIGS. 2 and 3 and is included to show the provision of a hydraulic damper device in association with the pyrotechnic actuator piston/cylinder.

FIG. 3A shows the arrangement of FIGS. 2 and 3 with the addition of the hydraulic damper 121 adjacent the piston 21. This hydraulically limits the velocity of the piston 25, thereby limiting the velocity of the actuator mechanism and the deployment velocity of the fin 14. It comprises a container of hydraulic fluid with a suitably small flow aperture to limit the flow of the damping fluid.

As perhaps more clearly shown in the schematic drawing of FIG. 3, the forward part 30 of the cover 16 develops an air pocket 32 which causes the cover 16 to continue its rotation and ejection from the missile.

Figure 4:
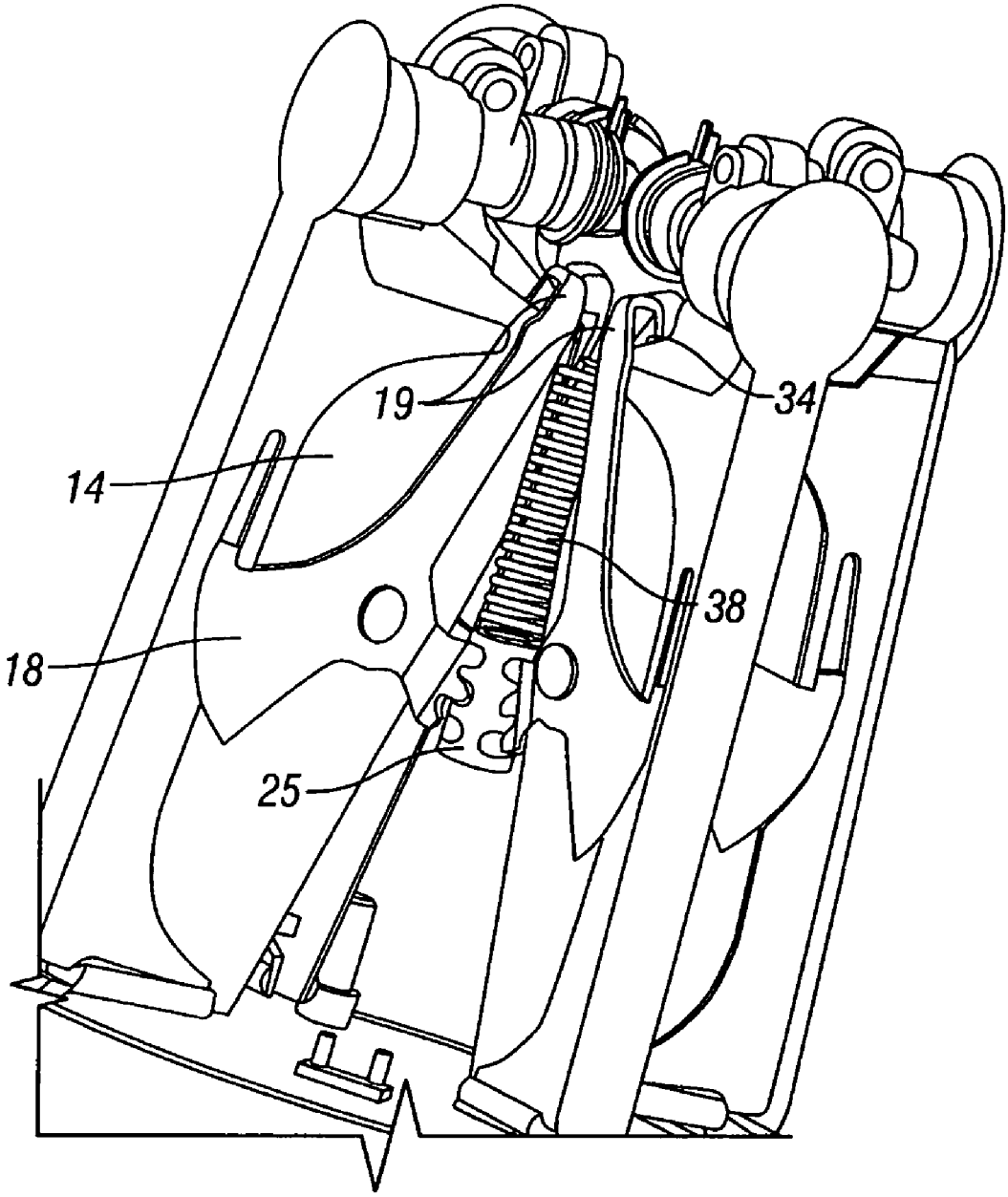
FIG. 4 is a schematic three-dimensional view showing further details of the apparatus of FIG. 2.

The structural configuration of the latch arm 18 is better shown in the three-dimensional schematic view of FIG. 4. It actually comprises parallel latch arm portions on opposite sides of the fin 14 joined together by a bridge portion 19 which applies force to the cam surface 34 of the fin 14 as the latch arm 18 rotates to deploy the fin 14. A central bias spring 38 is shown in FIG. 4 extending forwardly of the piston 25.

Figure 5:
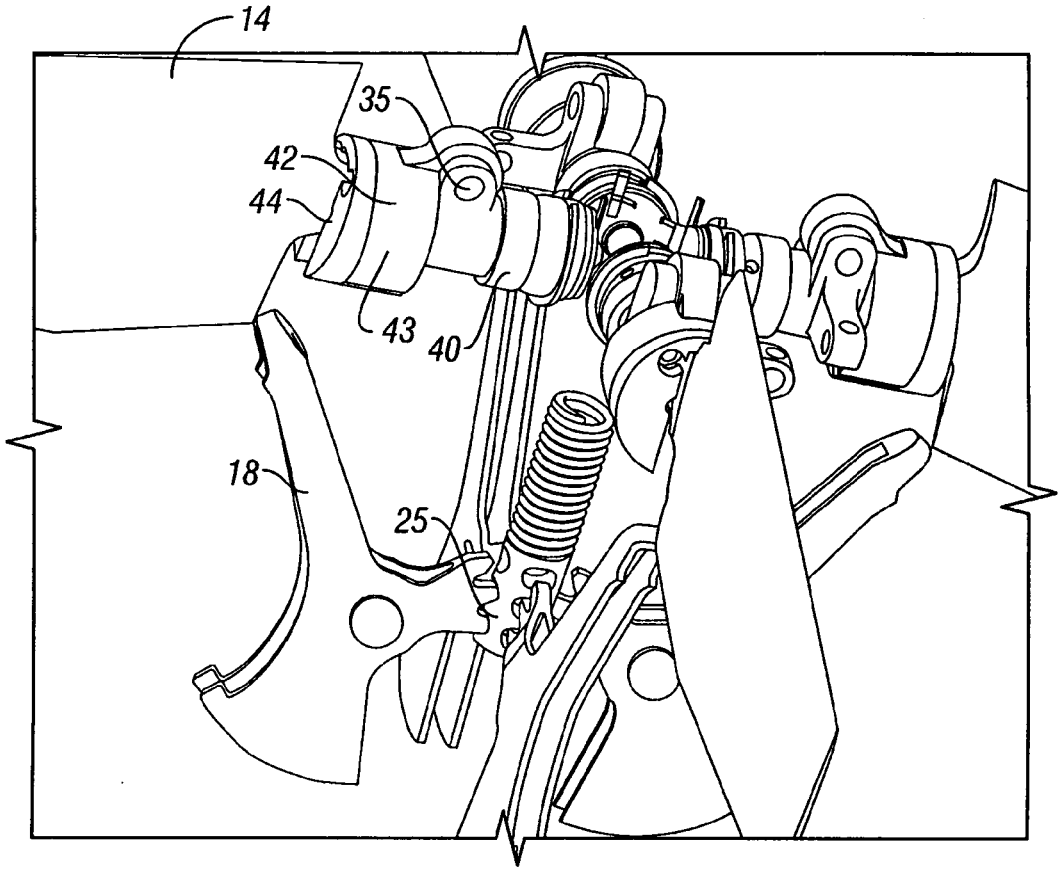
FIG. 5 is an enlarged schematic view of a portion of FIG. 2 showing the details of certain components with the fin fully deployed.
Figure 6:
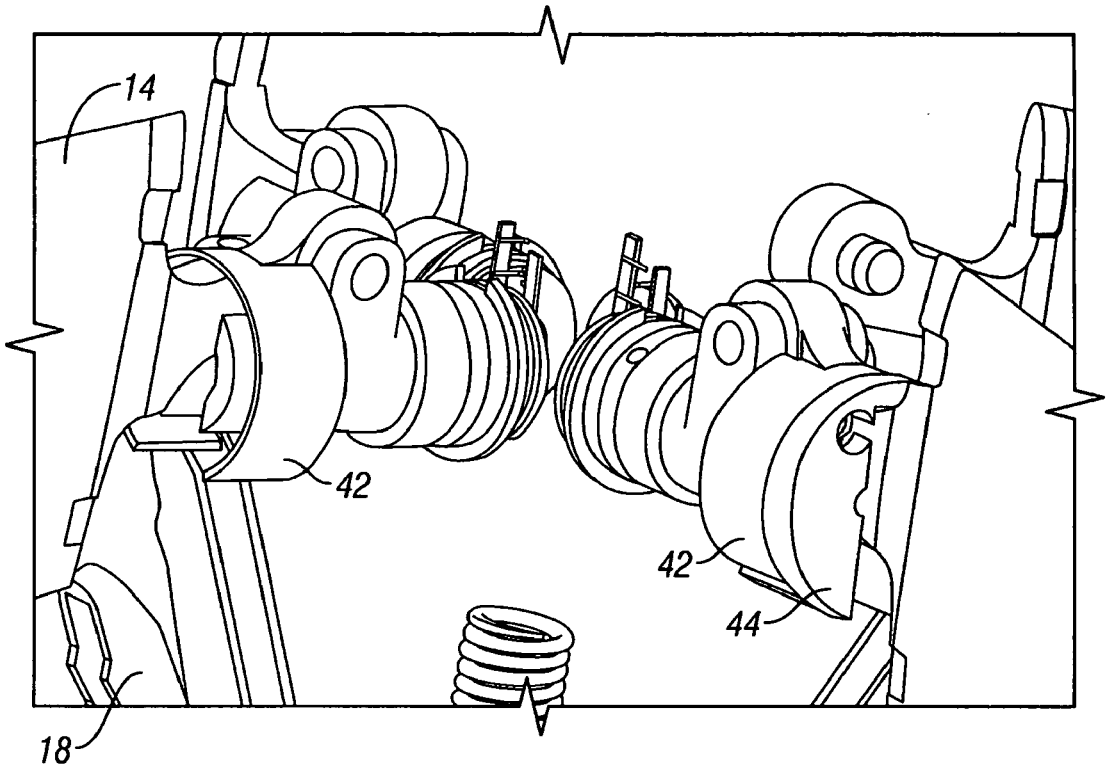
FIG. 6 is an enlarged schematic view, partially broken away, of components shown in FIG. 5.

FIG. 5 is a schematic exploded view of the operative elements of the actuator system 10 shown in position with the fins nearly deployed. In this view, the latch arm 18 has driven the fin 14 to a position of alignment with the fin steering shaft 40. In the mechanism shown in FIG. 5, the shaft portion supporting the fin 14 includes a retaining spring 42. This spring 42 is split along a line 43 on the bottom side (as shown in FIG. 5), or inner end, so that when the fin 14 hits it, upon deployment, it temporarily moves up on the bushing 44. It then springs back around the bushing 44 to hold the fin 14 in the fully deployed position. This action is shown more clearly in FIG. 6, which is an enlarged view of the portion of the mechanism shown in FIG. 5.

Figure 7:
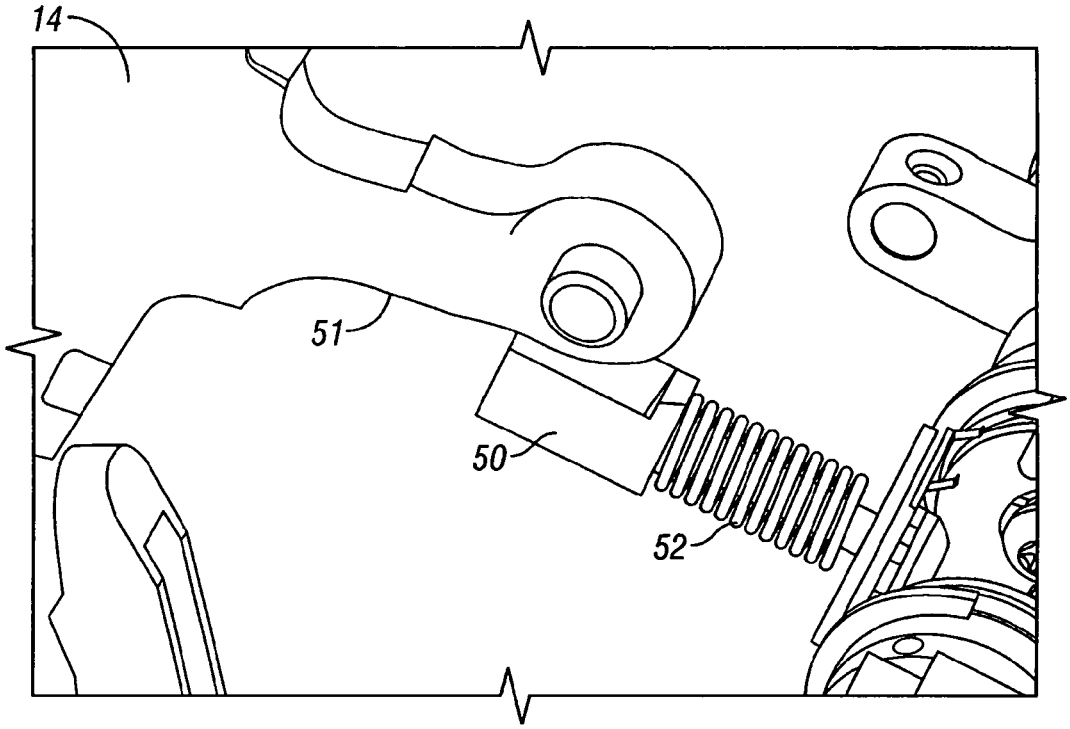
FIG. 7 is an enlarged schematic view, partially broken away, of a shaft and fin of FIG. 6.

As more particularly shown in FIG. 7, the locking wedge 50, which is internal to the shaft, is urged outwardly, when the fin rotates to the deployed position, by a biasing spring 52. Spring 52 pushes on the wedge 50 which in turn pushes on the fin to move it to the deployed position. In the final outward movement of the wedge 50, it rides underneath the inner end of the fin mounting element and locks the fin in the deployed position. This is shown in FIG. 8 where the biasing spring 52 is fully extended and the wedge 50 has reached its terminal position against the pivot arm of the fin 14, locking it in the deployed position.

Figure 8:
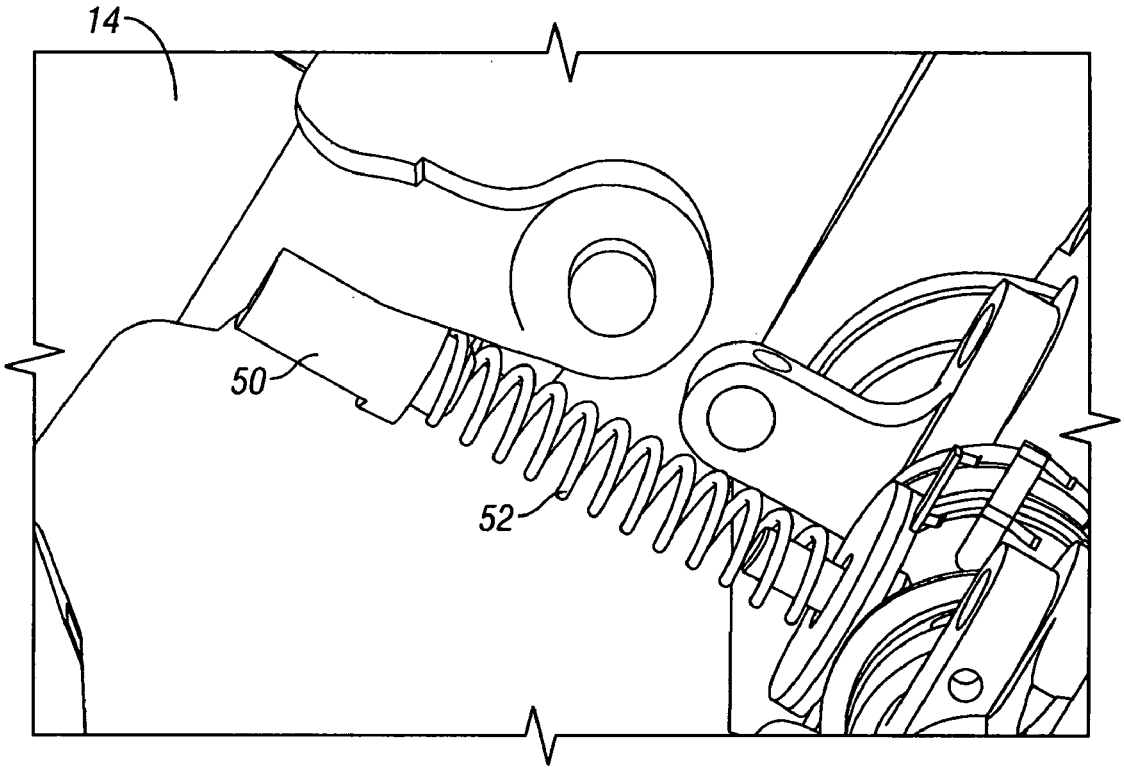
FIG. 8 is a view like that of FIG. 7 showing the final step in the deployment and locking of the fin.

As the wedge 50 moves radially outward, it bears against the camming surface 51 on the arm of the fin 14, ultimately locking it deployed as shown in FIG. 8.

Second Preferred Embodiment

Figure 9:
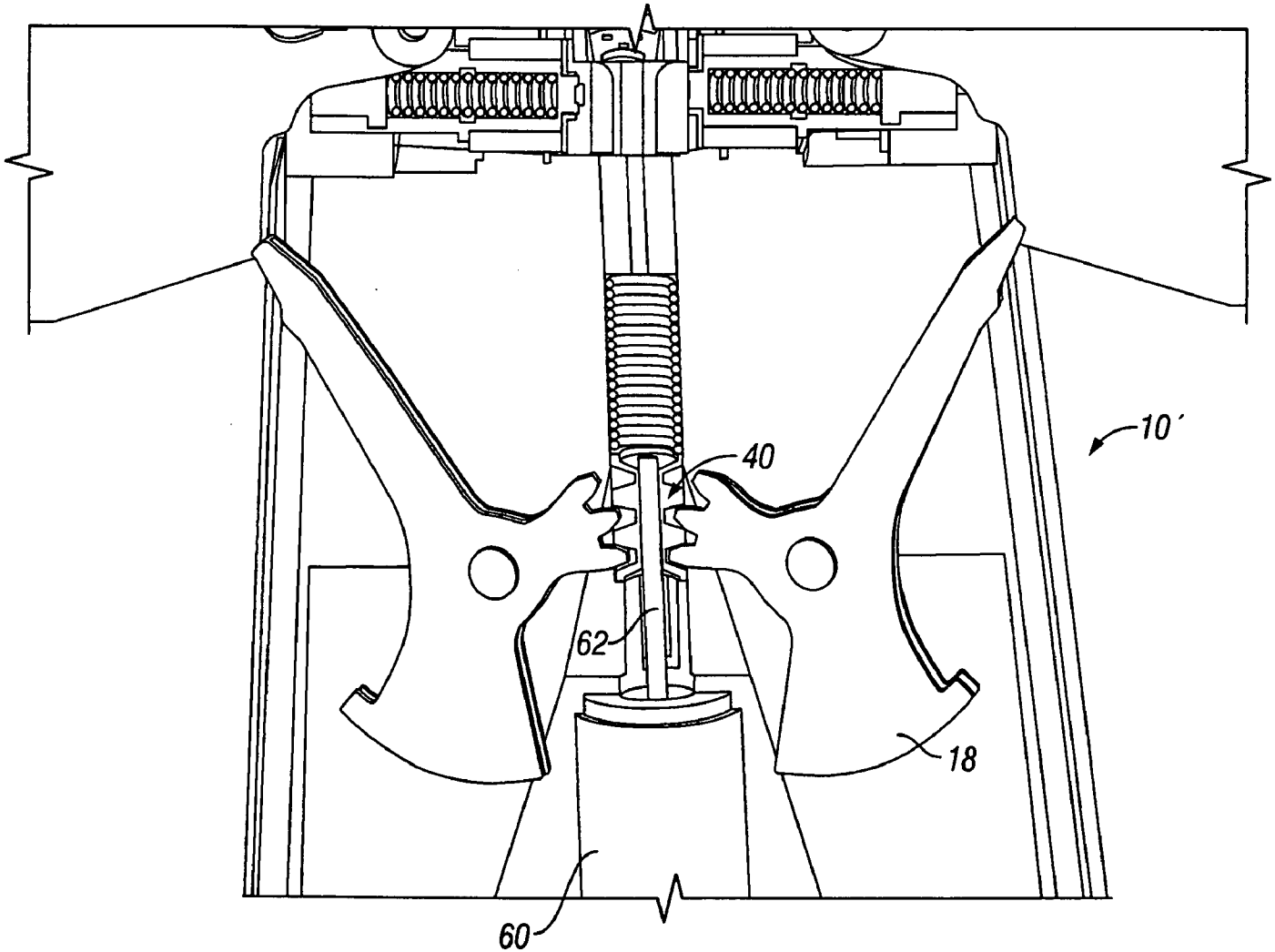
FIG. 9 is a schematic sectional view of a second preferred embodiment of an actuator system apparatus of the invention in which an electric motor is used in place of a pyrotechnic device to drive the ejection/deployment apparatus.
Figure 10:
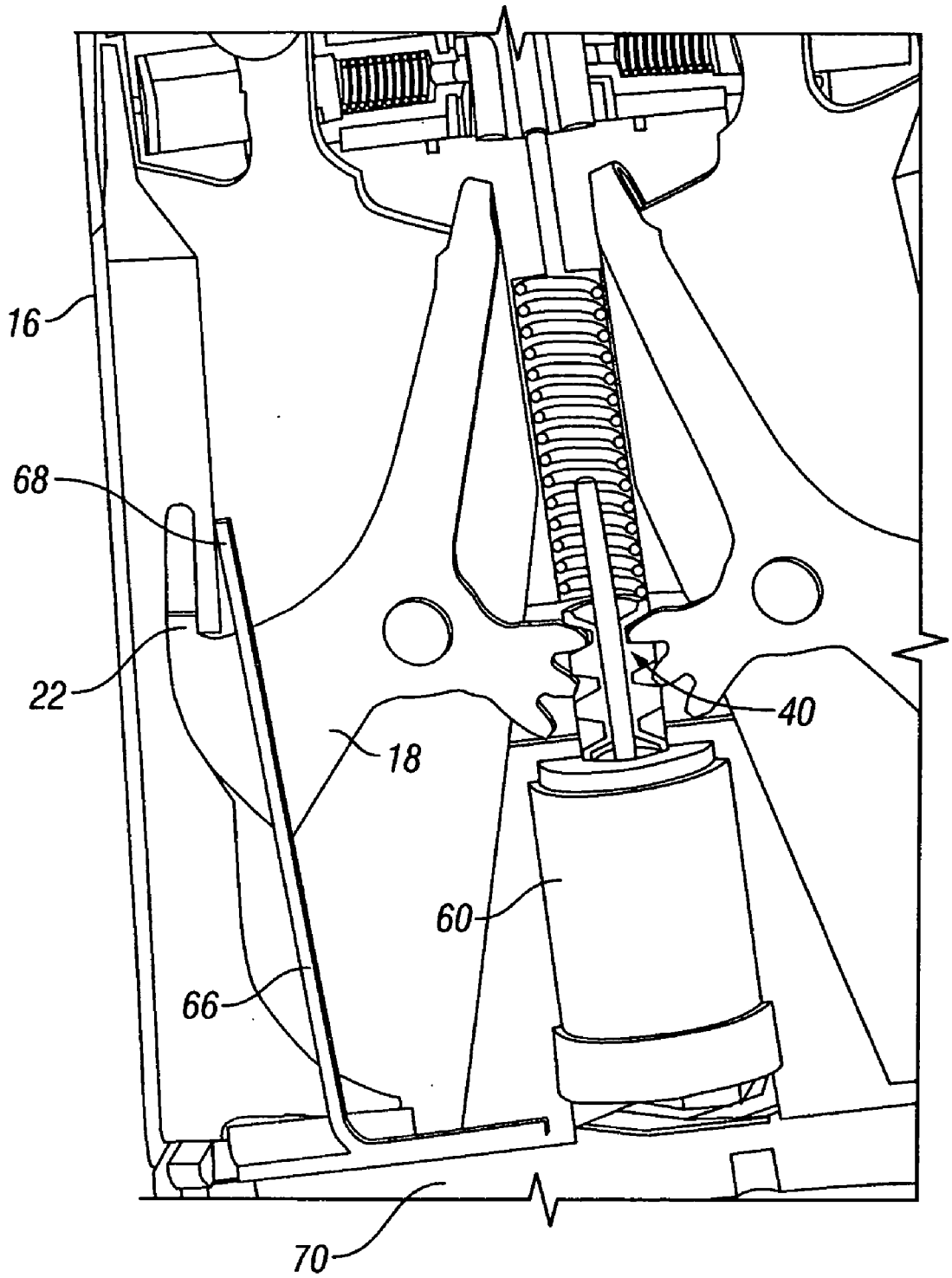
FIG. 10 is a schematic sectional view of a portion of the second preferred embodiment showing a helper spring arrangement in the embodiment of FIG. 9.

The alternative embodiment of FIGS. 9 and 10 shows the actuator system 10' with an electric motor 60 in place of the pyrotechnic device and piston of the embodiment of FIGS. 2–8. The motor 60 has a threaded shaft 62 which couples to the rack and sector gear 40, mating with an internally threaded portion thereof. Thus, as the motor 60 rotates the screw shaft 62, the gear mechanism 40 rotates the latch arms 18 in the manner described in the first embodiment.

Use of the electric motor 60 in the embodiment of FIGS. 9 and 10 provides a number of benefits, among which is the ability to reset and reuse the motor/actuator mechanism, thus making it easier to test the system prior to actual use. The electric motor drive also makes it possible to limit and control deployment velocity of the fins similar to the velocity damper on the pyrotechnic device as described above for the first embodiment. This is achieved through design of the motor with a limit on shaft RPMs and/or control of the electrical power supplied to the motor.

FIG. 10 shows the apparatus of FIG. 9 with the addition of a cover deploy spring 66. In a system utilizing a pyrotechnic actuator, the actuator provides high impulse power which serves to eject the covers with sufficient velocity to ensure that their trajectory clears the missile tail fins. Such high energies are not easily achieved with an electric motor. The embodiment of FIG. 10 utilizes a helper spring 66 to provide additional ejection force for the cover from the energy stored in the spring. The spring 66 is mounted to the cover at the point 68. The spring is compressed during installation of the cover by bending it against the surface 70. When the latch at 22 is released by the electric motor 60 driving the latch arm 18, the spring 66 accelerates the cover away from the missile body, thus avoiding the tail fins being hit by the cover 16.

Although there have been described hereinabove various specific arrangements of a COVER EJECTION AND FIN DEPLOYMENT SYSTEM FOR A GUN-LAUNCHED PROJECTILE in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Apparatus for covering and deploying folded steering fins of a missile in flight, wherein for each fin there is an associated cover which defines a slot for engaging a locking member in the closed position and a first camming surface for ejecting the cover, said apparatus comprising:

a plurality of deployment actuators, one for each fin, each actuator having a rotatable link mounted on a pivot pin disposed in a hole in the rotatable ink, the rotatable link including a first portion comprising a locking member for engaging said slot in said cover to lock said cover in a closed position and a second portion having a second camming surface for bearing against the first camming surface of the cover to drive the cover radially outward into the slipstream for jettisoning from the missile.

2. The apparatus of claim 1 wherein said rotatable link further includes a forwardly extending arm portion positioned to contact an inwardly extending projection of said cover to assist in driving the cover outward into the slipstream for jettisoning.

3. The apparatus of claim 1 wherein said fin is pivoted for rotation to its deployed position.

4. The apparatus of claim 2 wherein said arm portion of said link comprises a pair of plates positioned on opposite sides of the fin, said plates being joined at their outer ends by a bridge section for contacting an edge of the fin to drive it toward the deployed position as the link rotates.

5. The apparatus of claim 1 further including driving means centrally positioned along the longitudinal axis of the missile and having means for engaging all deployment actuators concurrently to cause jettisoning of all covers together.

6. The apparatus of claim 5 wherein said driving means comprise a central gear drive coupling each rotatable link to gear teeth on the central shaft.

7. The apparatus of claim 6 further comprising means for propelling the central shaft in an axial direction to cause the link of each deployment actuator to rotate in a motion to release and jettison the associated cover and drive the associated fin to its deployed position.

8. The apparatus of claim 7 wherein the means for propelling the central shaft in an axial direction comprises a pyrotechnic device and an associated actuator piston, said piston being coupled to propel said central shaft in an axial direction following the ignition of said pyrotechnic device.

9. The apparatus of claim 7 wherein said means for propelling the central shaft in an axial direction comprises an electric motor and drive screw actuator.

10. The apparatus of claim 3 wherein each of said fins when in the deployed position is rotatable about a transverse fin axis which is generally orthogonal to the central axis of the missile.

11. The apparatus of claim 1 wherein each deployment actuator includes a cover deployment spring mounted to bear against the cover and provide additional deployment force when the cover is unlatched in preparation for deployment.

12. The apparatus of claim 1 wherein said plurality of deployment actuators are mounted in a forward portion of the missile such that each fin acts as a canard in controlling missile flight.

13. The apparatus of claim 1 wherein each associated cover is configured to provide aerodynamic fairing and, when the cover is in the closed position, to seal the cover in said slot to protect the corresponding actuator assembly during long-term storage.

14. The apparatus of claim 2 wherein said cover is configured to develop an air pocket adjacent the forward portion of the cover to accelerate the ejection of the cover from the missile.

15. The apparatus of claim 8 further including a hydraulic damper adjacent said actuator piston for limiting the velocity of the piston during deployment, and thereby limit the deployment velocity of the fin.

16. The apparatus of claim 7 further comprising a biasing spring mounted along the shaft of said central axis forward of said propelling means for urging the rotatable links of the deployment assemblies to compete their deployment, once the covers are jettisoned.

17. The apparatus of claim 10 further including a rotation control assembly for controlling the angle of the deployed fin about said orthogonal fin axis.

18. The apparatus of claim 17 wherein said rotation control assembly further comprises a bushing concentric with said orthogonal axis and an adjacent concentric clamping spring for clamping about said bushing to hold the fin in the fully deployed position, said clamping spring being split along its length to permit the spring to be mounted on the bushing contacted by the fin reaching full deployment.

19. The apparatus of claim 18 further comprising a wedge member movable along said transverse axis to a position adjacent the fin support arm when the fin is fully deployed to maintain the fin in said fully deployed position.

20. The apparatus of claim 19 further including a biasing spring for each fin assembly, said biasing spring being positioned along said transverse axis to bias said wedge member radially outward into a position to maintain the fin fully deployed.

* * * * *